US007755653B2

(12) United States Patent
Takamori

(10) Patent No.: US 7,755,653 B2
(45) Date of Patent: Jul. 13, 2010

(54) IMAGE DISPLAY SYSTEM AND RECEIVER DEVICE

(75) Inventor: Tomotsugu Takamori, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 974 days.

(21) Appl. No.: 11/518,983

(22) Filed: Sep. 12, 2006

(65) Prior Publication Data

US 2007/0057931 A1 Mar. 15, 2007

(30) Foreign Application Priority Data

Sep. 13, 2005 (JP) ..... 2005-265391

(51) Int. Cl.
*G09G 5/02* (2006.01)

(52) U.S. Cl. ..... 345/699; 345/204; 710/302; 386/124

(58) Field of Classification Search ..... 345/699, 345/204; 710/302; 386/123, 124
See application file for complete search history.

(56) References Cited

U.S. PATENT DOCUMENTS

| | | | | |
|---|---|---|---|---|
| 2004/0080671 | A1* | 4/2004 | Siemens et al. | 348/473 |
| 2005/0068346 | A1* | 3/2005 | Ogawa et al. | 345/699 |
| 2006/0208929 | A1* | 9/2006 | Cho | 341/50 |
| 2007/0055876 | A1* | 3/2007 | Choi | 713/170 |
| 2007/0186015 | A1* | 8/2007 | Taft et al. | 710/16 |
| 2007/0283071 | A1* | 12/2007 | Konishi | 710/302 |

FOREIGN PATENT DOCUMENTS

| | | | |
|---|---|---|---|
| JP | A-2000-194346 | * | 7/2000 |
| JP | A-2005-084881 | * | 3/2005 |
| JP | A-2005-109703 | * | 4/2005 |

* cited by examiner

*Primary Examiner*—Lun-Yi Lao
(74) *Attorney, Agent, or Firm*—Morgan Lewis & Bockius LLP

(57) ABSTRACT

An image display system includes a transmitter device that can transmit video data and audio data, and a receiver device that is connected via an HDMI cable to the transmitter device and that includes a display device that displays video based on video data from the transmitter device and an audio output device that outputs audio based on audio data from the transmitter device. The receiver device includes an HDMI receiver that, when the receiver device is connected via the HDMI cable to the transmitter device and then receives therefrom an EDID request, transmits EDID, and that thereafter, when the receiver device receives video data and audio data from the transmitter device, checks whether or not the receiver device has received EDID-complying data so that, if EDID-complying data is found to have been received, the HDMI receiver decodes and outputs the video data and the audio data to the display device and the audio output device respectively and, if non-EDID-complying data is found to have been received, the HDMI receiver, by once cutting off the connection via the HDMI cable or turning off the receiver device, makes the transmitter device perform again the operation for acquiring EDID to thereby acquire correct EDID.

5 Claims, 3 Drawing Sheets

IMAGE DISPLAY SYSTEM AND RECEIVER DEVICE

This application is based on Japanese Patent Application No. 2005-265391 filed on Sep. 13, 2005, the contents of which are hereby incorporated by reference.

BACKGROUND OF THE INVENTION

1. Field of the Invention

The present invention relates to an image display system including a transmitter device that can transmit video data and audio data and a receiver device that is connected via an HDMI cable to the transmitter device and that has the capabilities of displaying video based on video data from the transmitter device and of outputting audio based on audio data from the transmitter device. The present invention also relates to a receiver device for use in such an image display system.

2. Description of Related Art

Thanks to advancements in liquid crystal panel fabrication technologies, recent years have seen remarkable developments in the super-high definition displays of television monitors that are designed to be used in combination with DVD players or the like. This has made it possible to display a huge amount of video data with high definition. In such a television monitor, to cope with a huge amount of video data and audio data transmitted from a DVD player or the like, an interface called HDMI (high-definition multimedia interface) is used.

The HDMI is an interface designed for the transfer of video data and audio data from a transmitter device, such as a DVD player, to a receiver device, such as a television monitor or a projector. The HDMI is an expanded version of the conventionally formulated DVI (digital visual interface for computer) Ver. 1.0. Specifically, whereas the DVI is formulated to handle the transmission of video data alone, the HDMI is formulated to handle the transmission, via a single cable, of not only video data but also audio and other data. Furthermore, the HDMI permits the transfer of high-quality, multichannel audio data along with high-definition, multiple-format video data.

The HDMI can also be used in DDC (display data channel) communication to transfer various kinds of data (for example, information on a monitor, such as an EDID data structure). EDID (extended display identification data) includes, to name a few, the resolutions at which a receiver device can receive data, information on audio streams, and information on the speakers available on the part of the receiver. Moreover, the HDMI permits the transfer of video data and audio data via a single cable, and thus has the advantage of eliminating the trouble of connecting a number of cables. For example, in a case where contents of a CSS (content scrambling system) is outputted from a DVD player, the HDMI is an interface approved by the CPAC (copy protection advisory council).

The above-mentioned DDC refers to a type of communication, and denotes a network over which data relating to display conditions for video data and conditions for audio data is, along with other data relating to an HDMI monitor, transmitted to a DVD player. The DDC is connected to a communication line within the DVD player, and is used to establish a network between the DVD player and the HDMI monitor. The above-mentioned CSS denotes a system that encrypts data for recording and decrypts it for playback.

In a conventionally known image display system (for example, see JP-A-2005-109703), the HDMI described above is used to connect together a DVD player as a transmitter device and an HDMI monitor as a receiver device. According to this conventional technology, the DVD playback device (DVD player) acquires, from the HDMI monitor beforehand, condition information representing the display conditions of the HDMI monitor and, based on the acquired condition information, converts image information (video data), makes settings related to the image information on a display device, and outputs the converted image information to the HDMI monitor.

However, according to the conventional technology disclosed in JP-A-2005-109703, although the DVD playback device, based on the acquired condition information, converts image information, makes settings related to the image information on a display device, and outputs the converted image information to the HDMI monitor, when the EDID information that the DVD playback device has received from the HDMI monitor is irrelevant, since the HDMI monitor does not so operate as to make the DVD playback device acquire correct EDID information, inconveniently, the image information from the DVD playback device cannot be displayed on the HDMI monitor.

That is, according to the conventional technology, when the EDID information that the transmitter device that outputs video data and audio data has received from the receiver device is irrelevant, the receiver device can transmit EDID information in response to a request from the transmitter device, but cannot confirm whether or not its acquisition has correctly been performed, and, if not, inconveniently, the image information from the transmitter device cannot be displayed on the receiver device.

According to the conventional technology disclosed in JP-A-2005-84881, an image processing device receives parameter information and, based on the received parameter information, performs image processing, and request an image display device to change parameter information. When the EDID information that the image processing device has receives is irrelevant, the image display device cannot confirm whether or not the EDID information is irrelevant. Thus, this technology does not solve the aforementioned inconveniences.

According to the conventional technology disclosed in JP-A-2000-194346, as the display state changes according to user control or the like, EDID information is updated, and the updated EDID information is transmitted to a personal computer. When the EDID information that the personal computer has received from a display device is irrelevant, the display device cannot confirm whether or not the personal computer has correctly received it, and, if not, inconveniently, the image information from the personal computer cannot be displayed on the display device.

SUMMARY OF THE INVENTION

To overcome the conventionally experienced inconveniences as discussed above, an object of the present invention is to provide an image display system in which, when a transmitter device transmits a non-EDID-complying data to a receiver device, the receiver device can make the transmitter device execute again an operation for acquiring EDID. Another object of the present invention is to provide a receiver device for use in such an image display system.

To achieve the above objects, according to the present invention, an image display system includes: a transmitter device that can transmit video data and audio data; and a receiver device that is connected via an HDMI cable to the transmitter device and that includes a display device that displays video based on video data from the transmitter device and an audio output device that outputs audio based on audio data from the transmitter device. Here, the receiver device is provided with an HDMI receiver that, when the receiver device is connected via the HDMI cable to the transmitter device and then receives therefrom an EDID request, transmits EDID, and that thereafter, when the receiver device receives video data and audio data from the transmitter device, checks whether or not the receiver device has received EDID-complying data so that, if EDID-complying data is found to have been received, the HDMI receiver decodes and outputs the video data and the audio data to the display device and the audio output device respectively and, if non-EDID-complying data is found to have been received, the HDMI receiver, by once cutting off the connection via the HDMI cable or turning off the receiver device, makes the transmitter device perform again the operation for acquiring EDID to thereby acquire correct EDID.

In this configuration, when the receiver device is connected via the HDMI cable to the transmitter device and then receives therefrom an EDID request, the receiver device transmits EDID to the transmitter device. Thereafter, when the receiver device receives video data and audio data from the transmitter device, if EDID-complying data is found to be received, the receiver device decodes the video data and the audio data and outputs it to the display device and the audio output device respectively. By contrast, if non-EDID-complying data is found to be received, the receiver device, by once cutting off the connection via the HDMI cable or turning off the receiver device, makes the transmitter device perform again the operation for acquiring EDID to thereby acquire correct EDID.

With this configuration, if the transmitter device transmits non-EDID-complying data to the receiver device, the receiver device can make the transmitter device perform again the operation for acquiring EDID. Thus, even if the transmitter device transmits EDID other than that for compatible resolutions that should be contained in the EDID to the display device, the EDID, which is likely to have been acquired incorrectly, can be replaced with newly acquired EDID. This eliminates situations where image information from the transmitter device cannot be displayed on the receiver device, and thus helps enhance the reliability of the system.

Alternatively, according to the present invention, an image display system includes: a transmitter device that can transmit video data and audio data; and a receiver device that is connected via an HDMI cable to the transmitter device and that includes a display device that displays video based on video data from the transmitter device and an audio output device that outputs audio based on audio data from the transmitter device. Here, the receiver device is provided with an HDMI receiver, which is provided with: a cable connection checker that, according to whether a hot-plug state for detection of connection is on or off, checks whether or not the HDMI cable for connection to the transmitter device is connected; an EDID request checker that, when the HDMI cable is found to be connected, checks whether or not an EDID request is being transmitted from the transmitter device; an EDID transmitter that, when an EDID request is found to be being transmitted, transmits EDID to the transmitter device; an EDID compliance checker that, when video data and audio data from the transmitter device is received, checks whether or not EDID-complying data is received; a data outputter that, when EDID-complying data is found to be received, decodes and outputs the video data and the audio data to the display device and the audio output device respectively; a hot-plug/receiver-sense disabler that, when non-EDID-complying data is found to be received, turns off the hot-plug state or turns off a receiver-sense state that indicates whether the receiver device is on or off; and an execution returner that, after the hot-plug state or the receiver-sense state is turned off, turns the hot-plug state on to return execution to the cable connection checker.

In this configuration, according to whether the hot-plug state is on or off, the cable connection checker checks whether or not the HDMI cable for connection to the transmitter device is connected. If the HDMI cable is found to be connected, the EDID request checker checks whether or not an EDID request is being transmitted from the transmitter device. If an EDID request is found to be being transmitted, the EDID transmitter transmits EDID to the transmitter device. When video data and audio data from the transmitter device is received, the EDID compliance checker checks whether or not EDID-complying data is received. If EDID-complying data is found to be received, the data outputter decodes the video data and the audio data and outputs it to the display device and the audio output device respectively.

If no EDID-complying data is found to be received, in other words, if non-EDID-complying data is found to be received, the hot-plug/receiver-sense disabler turns off the hot-plug state or the receiver-sense state. After the hot-plug state or the receiver-sense state is turned off, the execution returner turns the hot-plug state on to return execution to the cable connection checker.

With this configuration, if the transmitter device transmits non-EDID-complying data to the receiver device, the receiver device can, by turning the hot-plug state or the receiver-sense state off, make the transmitter device perform again the operation for acquiring EDID. Thus, even if the transmitter device transmits EDID other than that for compatible resolutions that should be contained in the EDID to the display device, the EDID, which is likely to have been acquired incorrectly, can be replaced with newly acquired EDID. This eliminates situations where image information from the transmitter device cannot be displayed on the receiver device, and thus helps enhance the reliability of the system.

Moreover, according to the present invention, a receiver apparatus for use in an image display system as described above is configured as described above.

DETAILED DESCRIPTION OF PREFERRED EMBODIMENTS

Figure 1:
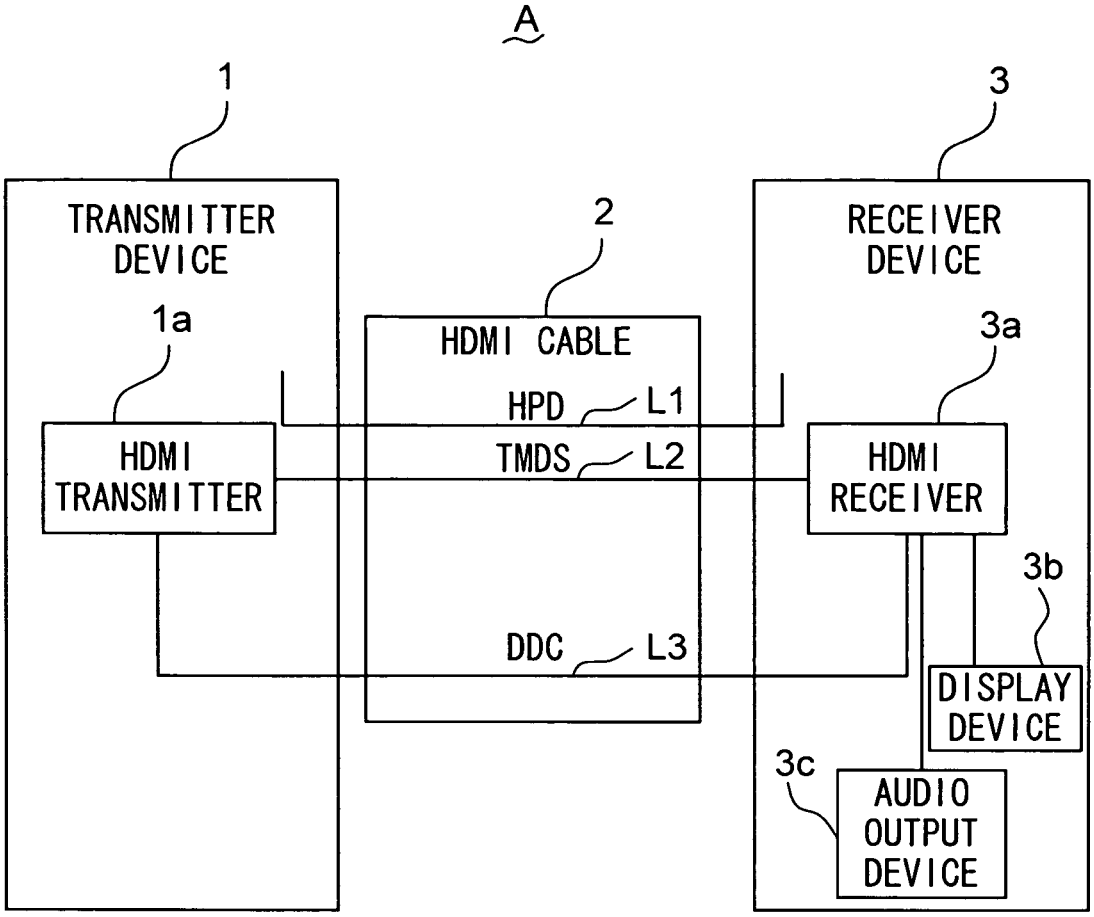
FIG. 1 is a block diagram showing an image display system embodying the present invention.

Hereinafter, an embodiment of the present invention will be described with reference to the drawings. FIG. 1 is a block diagram showing an image display system embodying the present invention.

As shown in FIG. 1, the image display system A is composed of: a transmitter device 1, such as a DVD player furnished with an HDMI terminal, that can transmit video data and audio data; and a receiver device 3, such as a television monitor or a projector, that is connected via an HDMI cable 2 to the transmitter device 1 and that has the capabilities of displaying video based on video data from the transmitter device 1 and of outputting audio based on audio data from the transmitter device 1.

The transmitter device 1 is provided with an HDMI transmitter 1*a* that transmits video data and audio data conforming to the HDMI standard. The HDMI cable 2 is provided with: a TMDS line L2 via which the video data and the audio data from the HDMI transmitter 1*a* is transmitted to the receiver device 3 by a TMDS (transition minimized differential signaling) method; an HPD (hot-plug detector) line L1 via which whether or not the transmitter device 1 and the receiver device 3 are connected together is detected; and a DDC (display data channel) line L3 via which the transmitter device 1 acquires condition information including information on display conditions from the receiver device 3. The receiver device 3 is provided with an HDMI receiver 3*a*, a display device 3*b*, and an audio output device 3*c*.

The HDMI receiver 3*a* includes: a cable connection checker that, according to whether the hot-plug state for detection of connection is on or off, checks whether or not the HDMI cable 2 for connection to the transmitter device 1 is connected; an EDID request checker that, when the HDMI cable is found to be connected, checks whether or not an EDID request is being transmitted from the transmitter device 1; an EDID transmitter that, when an EDID request is found to be being transmitted, transmits EDID to the transmitter device 1; an EDID compliance checker that, when video data and audio data from the transmitter device 1 is received, checks whether or not EDID-complying data is received; a data outputter that, when EDID-complying data is found to be received, decodes the video data and the audio data and outputs it to the display device and the audio output device respectively; a hot-plug/receiver-sense disabler that, when non-EDID-complying data is found to be received, turns off the hot-plug state or turns off the receiver-sense state that indicates whether the receiver device 3 is on or off; and an execution returner that, after the hot-plug state or the receiver-sense state is turned off, turns the hot-plug state on to return execution to the cable connection checker.

Figure 2:
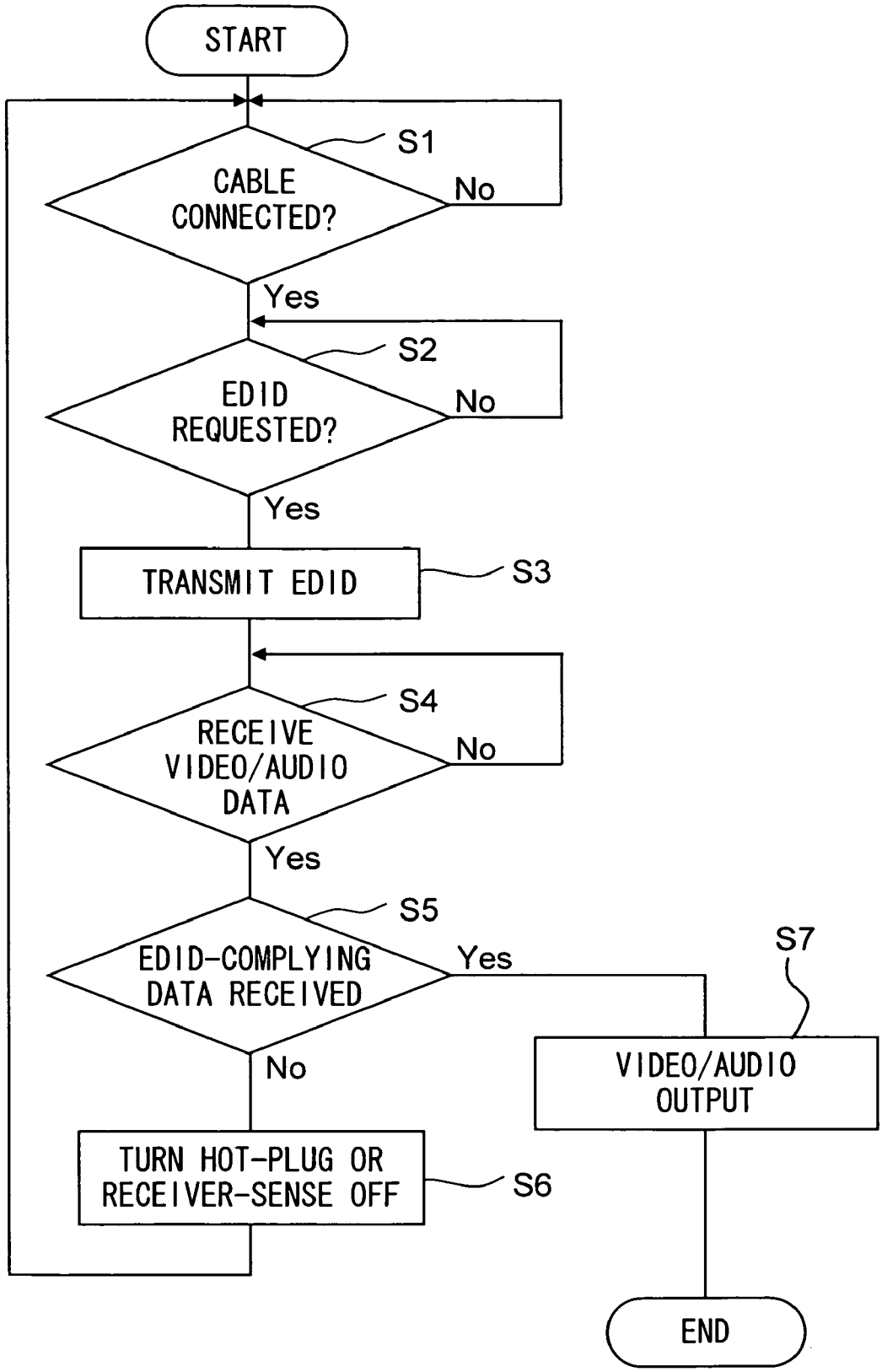
FIG. 2 is a flow chart illustrating the operation for acquiring EDID, as a distinctive feature of an HDMI receiver incorporated in a receiver device in the embodiment of the present invention.

Now, as a distinctive feature of the HDMI receiver 3*a* incorporated in the receiver device 3 in this embodiment, the operation for acquiring EDID will be described with the flow chart in FIG. 2 as well as FIG. 1.

When the receiver device 3 displays video and outputs audio based on video data and audio data transmitted from the transmitter device 1, the HDMI receiver 3*a* of the receiver device 3 operates in the following manner.

First, according to whether the hot-plug state on the HPD line L1 is on or off, the cable connection checker checks whether or not the HDMI cable 2 for connection to the transmitter device 1 is connected (step S1). If the HDMI cable is found to be connected, the EDID request checker checks whether or not an EDID request is being transmitted from the transmitter device 1 (step S2).

If an EDID request is found to be being transmitted, the EDID transmitter transmits EDID to the transmitter device 1 (step S3). Now, the HDMI transmitter 1*a* of the transmitter device 1 determines the resolution and the audio stream, and then transmits video data and audio data. When video data and audio data from the transmitter device 1 is received (step S4), the EDID compliance checker checks whether or not EDID-complying data is received (step S5). If EDID-complying data is found to be received, the data outputter decodes the video data and the audio data and outputs it to the display device 3*b* and the audio output device 3*c* respectively (step S7).

If no EDID-complying data is found to be received (step S5), in other words, if non-EDID-complying data is found to be received, the hot-plug/receiver-sense disabler turns off the hot-plug state or the receiver-sense state that indicates whether the receiver device 3 is on or off (step S6). After the hot-plug state or the receiver-sense state is turned off, the execution returner turns the hot-plug state on to return execution to the cable connection checker (back to step S1).

Incidentally, non-EDID-complying data includes: as video data, video data whose field frequency is incompatible with the display device 3*b*, whose resolution is incompatible with the display device 3*b*, whose composite video signal is incompatible with the display device 3*b*, whose component video signal is incompatible with the display device 3*b*, whose S video signal is incompatible with the display device 3*b*, etc.; as audio data, audio data whose LPCM is incompatible with the audio output device 3*c*, whose Dolby digital is incompatible with the audio output device 3*c*, whose DTS is incompatible with the audio output device 3*c*, etc.

Figure 3:
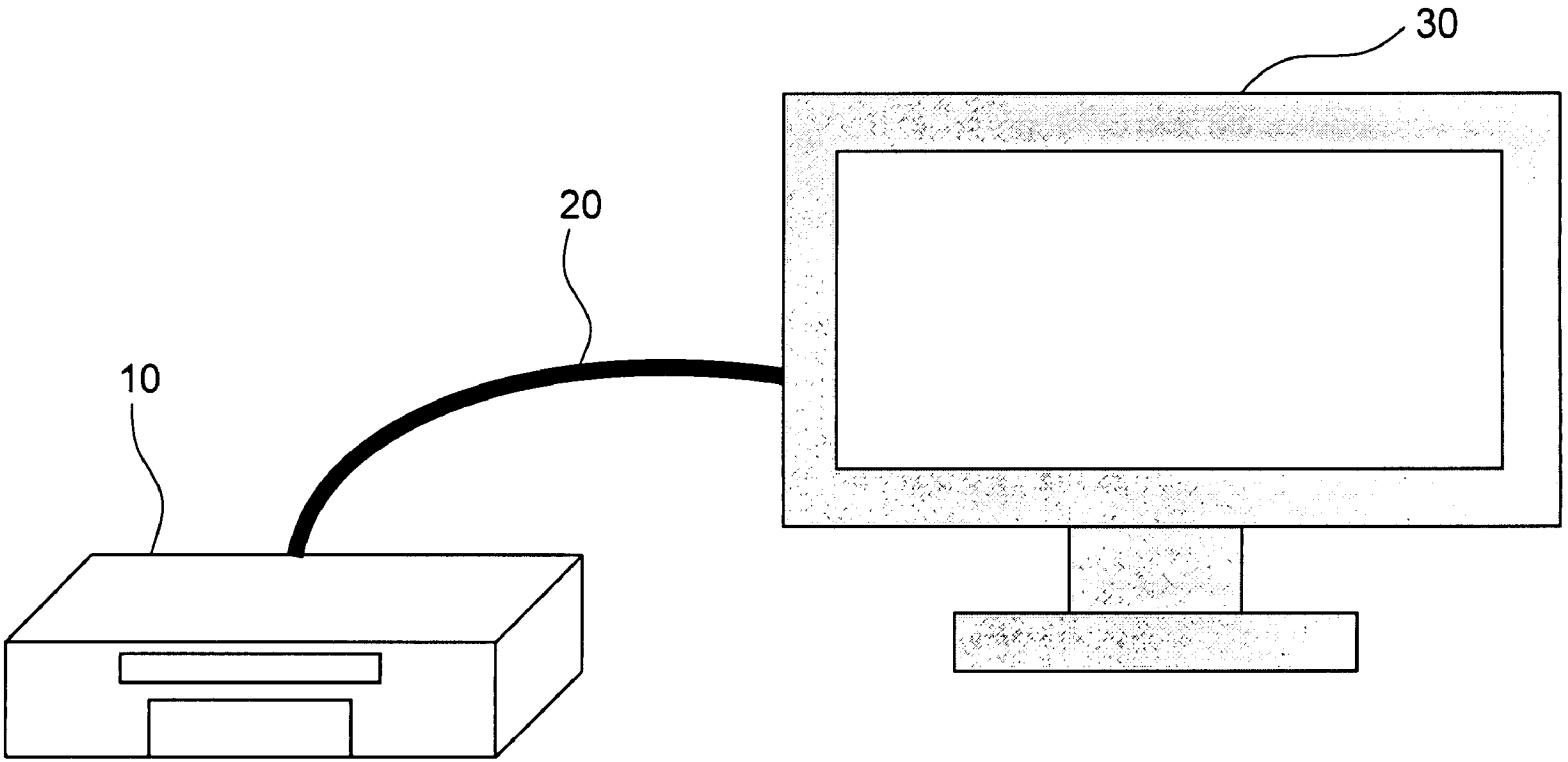
FIG. 3 is a diagram schematically showing an example of how HDMI devices are connected together in the image display system embodying the present invention.

FIG. 3 is a diagram schematically showing an example of how HDMI devices are connected together in the image display system of this embodiment. In FIG. 3, reference numeral 10 represents a DVD player serving as a transmitter device, and reference numeral 30 represents a television monitor serving as a receiver device. The DVD player 10 and the television monitor 30, each furnished with an HDMI terminal, are connected together by an HDMI cable 20. In this example, a DVD player is taken up as an example of the transmitter device; the transmitter device, however, is not limited thereto, but may be any other device, such as a DVD recorder or a videocassette recorder furnished with an HDMI terminal, that outputs video data and audio data. On the other hand, the receiver device is not limited to a television monitor, but may be a projector or the like.

As described above, according to this embodiment, if the transmitter device transmits non-EDID-complying data to the receiver device, the receiver device can, by turning the hot-plug state or the receiver-sense state off, make the transmitter device perform again the operation for acquiring EDID. Thus, even if the transmitter device transmits EDID other than that for compatible resolutions that should be contained in the EDID to the display device, the EDID, which is likely to have been acquired incorrectly, can be replaced with newly acquired EDID. This eliminates situations where image information from the transmitter device cannot be displayed on the receiver device, and thus helps enhance the reliability of the system.

What is claimed is:

1. An image display system including:

a transmitter device that can transmit video data and audio data; and a receiver device that is connected via an high-definition multimedia interface (HDMI) cable to the transmitter device and that includes a display device that displays video based on video data from the transmitter device and an audio output device that outputs audio based on audio data from the transmitter device, wherein the receiver device comprises an HDMI receiver that, when the receiver device is connected via the HDMI cable to the transmitter device and then receives therefrom an extended display identification data (EDID) request, transmits EDID, and that thereafter, when the receiver device receives video data and audio data from the transmitter device, checks whether or not the receiver device has received EDID-complying data so that if EDID-complying data is found to have been received, the HDMI receiver decodes and outputs the video data and the audio data to the display device and the audio output device respectively and if non-EDID-complying data is found to have been received, the HDMI receiver, by once cutting off connection via the HDMI cable or turning off the receiver device, makes the transmitter device perform again an operation for acquiring EDID to thereby acquire correct EDID.

2. The image display system of claim 1, wherein the HDMI receiver comprises:

a cable connection checker that, according to whether a hot-plug state for detection of connection is on or off, checks whether or not the HDMI cable for connection to the transmitter device is connected;

an EDID request checker that, when the HDMI cable is found to be connected, checks whether or not an EDID request is being transmitted from the transmitter device;

an EDID transmitter that, when an EDID request is found to be being transmitted, transmits EDID to the transmitter device;

an EDID compliance checker that, when video data and audio data from the transmitter device is received, checks whether or not EDID-complying data is received;

a data outputter that, when EDID-complying data is found to be received, decodes and outputs the video data and the audio data to the display device and the audio output device respectively;

a hot-plug/receiver-sense disabler that, when non-EDID-complying data is found to be received, turns off the hot-plug state or turns off a receiver-sense state that indicates whether the receiver device is on or off; and an execution returner that, after the hot-plug state or the receiver-sense state is turned off, turns the hot-plug state on to return execution to the cable connection checker.

3. An image display system including:

a transmitter device that can transmit video data and audio data; and a receiver device that is connected via an high-definition multimedia interface (HDMI) cable to the transmitter device and that includes a display device that displays video based on video data from the transmitter device and an audio output device that outputs audio based on audio data from the transmitter device, wherein the receiver device comprises an HDMI receiver comprising:

a cable connection checker that, according to whether a hot-plug state for detection of connection is no or off, checks whether or not the HDMI cable for connection to the transmitter device is connected;

an extended display identification data (EDID) request checker that, when the HDMI cable is found to be connected, checks whether or not an EDID request is being transmitted from the transmitter device;

an EDID transmitter that, when an EDID request is found to be being transmitted, transmits EDID to the transmitter device;

an EDID compliance checker that, when video data and audio data from the transmitter device is received, checks whether or not EDID-complying data is received;

a data outputter that, when EDID-complying data is found to be received, decodes and outputs the video data and the audio data to the display device and the audio output device respectively;

a hot-plug/receiver-sense disabler that, when non-EDID-complying data is found to be received, turns off the hot-plug state or turns off a receiver-sense state that indicates whether the receiver device is on or off; and an execution returner that, after the hot-plug state or the receiver-sense state is turned off, turns the hot-plug state on to return execution to the cable connection checker.

4. A receiver device that is connected via an high-definition multimedia interface (HDMI) cable to a transmitter device capable of transmitting video data and audio data and that includes a display device that displays video based on video data from the transmitter device and an audio output device that outputs audio based on audio data from the transmitter device, wherein the receiver device comprises an HDMI receiver that, when the receiver device is connected via the HDMI cable to the transmitter device and then receives therefrom an extended display identification data (EDID) request, transmits EDID, and that thereafter, when the receiver device receives video data and audio data from the transmitter device, checks whether or not the receiver device has received EDID-complying data so that if EDID-complying data is found to have been received, the HDMI receiver decodes and outputs the video data and the audio data to the display device and the audio output device respectively and if non-EDID-complying data is found to have been received, the HDMI receiver, by once cutting off connection via the HDMI cable or turning off the receiver device, makes the transmitter device perform again an operation for acquiring EDID to thereby acquire correct EDID.

5. The receiver device of claim 4, wherein the HDMI receiver comprises:

a cable connection checker that, according to whether a hot-plug state for detection of connection is on or off, checks whether or not the HDMI cable for connection to the transmitter device is connected;

an EDID request checker that, when the HDMI cable is found to be connected, checks whether or not an EDID request is being transmitted from the transmitter device;

an EDID transmitter that, when an EDID request is found to be being transmitted, transmits EDID to the transmitter device;

an EDID compliance checker that, when video data and audio data from the transmitter device is received, checks whether or not EDID-complying data is received;

a data outputter that, when EDID-complying data is found to be received, decodes and outputs the video data and the audio data to the display device and the audio output device respectively;

a hot-plug/receiver-sense disabler that, when non-EDID-complying data is found to be received, turns off the hot-plug state or turns off a receiver-sense state that indicates whether the receiver device is on or off; and an execution returner that, after the hot-plug state or the receiver-sense state is turned off, turns the hot-plug state on to return execution to the cable connection checker.

* * * * *